US008317937B2

(12) United States Patent
Kuniyoshi

(10) Patent No.: US 8,317,937 B2
(45) Date of Patent: Nov. 27, 2012

(54) ALLOY FOR SINTERED R-T-B-M MAGNET AND METHOD FOR PRODUCING SAME

(75) Inventor: Futoshi Kuniyoshi, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 13/260,755

(22) PCT Filed: Mar. 29, 2010

(86) PCT No.: PCT/JP2010/002276

§ 371 (c)(1),
(2), (4) Date: Sep. 28, 2011

(87) PCT Pub. No.: WO2010/113465

PCT Pub. Date: Oct. 7, 2010

(65) Prior Publication Data

US 2012/0032764 A1 Feb. 9, 2012

(30) Foreign Application Priority Data

Mar. 31, 2009 (JP) ..... 2009-083839

(51) Int. Cl.
*H01F 1/057* (2006.01)

(52) U.S. Cl. ..... 148/122; 148/101; 148/105; 148/302

(58) Field of Classification Search ..... None
See application file for complete search history.

(56) References Cited

U.S. PATENT DOCUMENTS

| | | | | |
|---|---|---|---|---|
| 5,383,978 | A | 1/1995 | Yamamoto et al. | |
| 2008/0257716 | A1 * | 10/2008 | Nagata et al. | 204/192.12 |
| 2008/0286595 | A1 | 11/2008 | Yoshimura et al. | |
| 2009/0019969 | A1 | 1/2009 | Kato et al. | |
| 2009/0252865 | A1 * | 10/2009 | Sagawa | 427/127 |
| 2009/0297699 | A1 * | 12/2009 | Baba et al. | 427/127 |
| 2009/0322459 | A1 * | 12/2009 | Nagata et al. | 335/302 |
| 2010/0003156 | A1 * | 1/2010 | Suzuki et al. | 419/10 |
| 2011/0012699 | A1 | 1/2011 | Odaka et al. | |

FOREIGN PATENT DOCUMENTS

JP 04-155902 A 5/1992

OTHER PUBLICATIONS

Official Communication issued in International Patent Application No. PCT/JP2010/002276, mailed on Jun. 29, 2010.
English translation of Official Communication issued in corresponding International Application PCT/JP2010/002276, mailed on Nov. 24, 2011.

* cited by examiner

*Primary Examiner* — John Sheehan
(74) *Attorney, Agent, or Firm* — Keating & Bennett, LLP

(57) ABSTRACT

In order to make a sintered R-T-B-M magnet so that $R_2T_{14}B$ phases that include a lot of Dy in the surface region of the main phase are distributed over the entire magnet, a region including a heavy rare-earth element RH at a high concentration is formed continuously beforehand at an interface between the crystals of an $R_2T_{14}B$ compound that is the main phase of the sintered R-T-B-M magnet and the other phases.

5 Claims, 2 Drawing Sheets

ALLOY FOR SINTERED R-T-B-M MAGNET AND METHOD FOR PRODUCING SAME

TECHNICAL FIELD

The present invention relates to a sintered R-T-B-M magnet material alloy, a method for producing such a sintered R-T-B-M magnet material alloy, and a method for producing a sintered R-T-B-M magnet.

BACKGROUND ART

A sintered R-T-B-M magnet, including an $R_2T_{14}B$ type compound as a main phase, is known as a permanent magnet with the highest performance, and has been used in various types of motors such as a voice coil motor for a hard disk drive and a motor for a hybrid car and in numerous types of consumer electronic appliances.

It has been known that if the rare-earth element R in the $R_2T_{14}B$ phase of a sintered R-T-B-M magnet is replaced with a heavy rare-earth element RH (which may be Dy and/or Tb), the coercivity will increase. To achieve high coercivity even at a high temperature, a lot of such a heavy rare-earth element RH needs to be added.

However, if the light rare-earth element RL (which may be at least one of Nd and Pr) of the sintered R-T-B-M magnet is replaced with the heavy rare-earth element RH, the coercivity will certainly increase but the remanence will decrease instead. Furthermore, as the heavy rare-earth element RH is one of rare natural resources, its use is preferably cut down.

For these reasons, the coercivity of a sintered R-T-B-M magnet should be increased effectively with the addition of as small an amount of the heavy rare-earth element RH as possible and without decreasing the remanence.

Thus, a lot of people are now researching techniques for distributing, as effectively as possible, only a small amount of the heavy rare-earth element RH added to the structure of a sintered R-T-B-M magnet in order to increase the coercivity and minimize the decrease in remanence.

Patent Documents Nos. 1 and 2 teach distributing Dy in the vicinity of the grain boundary phase of a sintered magnet by making the sintered magnet from an alloy powder with a relatively high Dy concentration and an alloy powder with a relatively low Dy concentration. According to those patent documents, if Dy is distributed in the vicinity of the grain boundary phase of a sintered magnet, the magnetic properties will improve.

On the other hand, Patent Document No. 3 discloses a technique for diffusing a heavy rare-earth element RH (which is at least one element selected from the group consisting of Dy, Ho and Tb) inward through the surface of a sintered magnet body by heating the magnet body with the heavy rare-earth element RH supplied onto its surface.

CITATION LIST

Patent Literature

Patent Document No. 1: Japanese Patent Application Laid-Open Publication No. 4-155902

Patent Document No. 2: PCT International Application Publication No. 2006/098204

Patent Document No. 3: PCT International Application Publication No. 2007/102391

SUMMARY OF INVENTION

Technical Problem

The technique disclosed in Patent Documents Nos. 1 and 2 is a so-called "two alloy blending" method. According to such a technique, it could be difficult to achieve the intended Dy distribution or there might be excessively grown crystal grains, thus often resulting in only a slight improvement of the magnetic properties.

Meanwhile, according to the technique disclosed in Patent Document No. 3, a high-remanence, high-coercivity sintered R-Fe-B magnet, of which the coercivity has increased significantly with its remanence hardly decreased, can be certainly obtained. Nevertheless, it is difficult to diffuse Dy right to the core of the magnet just as intended because Dy has to go all the way from the surface of the magnet. For that reason, such a technique is applicable to only magnets of limited sizes or applications.

It is therefore an object of the present invention to provide a sintered R-T-B-M magnet material alloy that has both high remanence and high coercivity everywhere.

Solution to Problem

A sintered R-T-B-M magnet material alloy according to the present invention has a composition that includes:

12 at % to 17 at % of R, which represents rare-earth elements that include both a light rare-earth element RL and a heavy rare-earth element RH and which always includes either Nd or Pr as the light rare-earth element RL and at least one of Tb, Dy and Ho as the heavy rare-earth element RH; 5 at % to 8 at % of B, part of which is replaceable with C; 2 a t % or less of an additive element M, which is at least one element selected from the group consisting of Al, Ti, V, Cr, Mn, Ni, Cu, Zn, Ga, Zr, Nb, Mo, Ag, In, Sn, Hf, Ta, W, Pb and Bi; and T (which is a transition metal that includes Fe as a major component and that possibly includes Co) and other inevitable impurities as the balance. A continuous region where the heavy rare-earth element RH has a high concentration is present at an interface between crystals of an $R_2T_{14}B$ compound that is a main phase and an R-rich phase so as to cover a length of at least 10 μm along the major axis of the crystals of the $R_2T_{14}B$ compound.

A method for producing a sintered R-T-B-M magnet material alloy according to the present invention includes the step of providing an R-T-B-M master alloy and either a heavy rare-earth metal or an alloy thereof, which includes 20 at % or more of a heavy rare-earth element RH that is at least one of Tb, Dy and Ho. The R-T-B-M master alloy includes: 12 at % to 17 at % of R, which represents rare-earth elements that include both a light rare-earth element RL and the heavy rare-earth element RH and which always includes either Nd or Pr as the light rare-earth element RL and at least one of Tb, Dy and Ho as the heavy rare-earth element RH; 5 at % to 8 at % of B, part of which is replaceable with C; 2 at % or less of an additive element M, which is at least one element selected from the group consisting of Al, Ti, V, Cr, Mn, Ni, Cu, Zn, Ga, Zr, Nb, Mo, Ag, In, Sn, Hf, Ta, W, Pb and Bi; and T (which is a transition metal that includes Fe as a major component and that possibly includes Co) and other inevitable impurities as the balance. The method further includes the step of putting the R-T-B-M master alloy and the metal or alloy of the heavy rare-earth element RH in a processing space and subjecting the master alloy and the metal or alloy of the heavy rare-earth element RH to a heat treatment at a temperature of 600° C. to 1,000° C. within an atmosphere at a pressure of 10 Pa or less for at least 10 minutes and up to 48 hours.

In one preferred embodiment, the R-T-B-M master alloy is prepared by strip casting process.

A method for producing a sintered R-T-B-M magnet according to the present invention includes the steps of: providing a sintered R-T-B-M magnet material alloy according to the preferred embodiment of the present invention described above; pulverizing the sintered R-T-B-M magnet material alloy to obtain a sintered R-T-B-M magnet material alloy powder; compacting the sintered R-T-B-M magnet material alloy powder to obtain a powder compact; and sintering the powder compact.

A sintered R-T-B-M magnet according to the present invention is produced by the method for producing a sintered R-T-B-M magnet of the present invention described above.

Advantageous Effects of Invention

According to the present invention, a region including a heavy rare-earth element RH at a high concentration is present at an interface between crystals of an $R_2T_{14}B$ compound that is a main phase and an R-rich phase so as to cover a length of at least 10 μm along the major axis of the crystals of the $R_2T_{14}B$ compound. Thus, the entire magnet can have its remanence and coercivity both increased.

DESCRIPTION OF EMBODIMENTS

Figure 1:
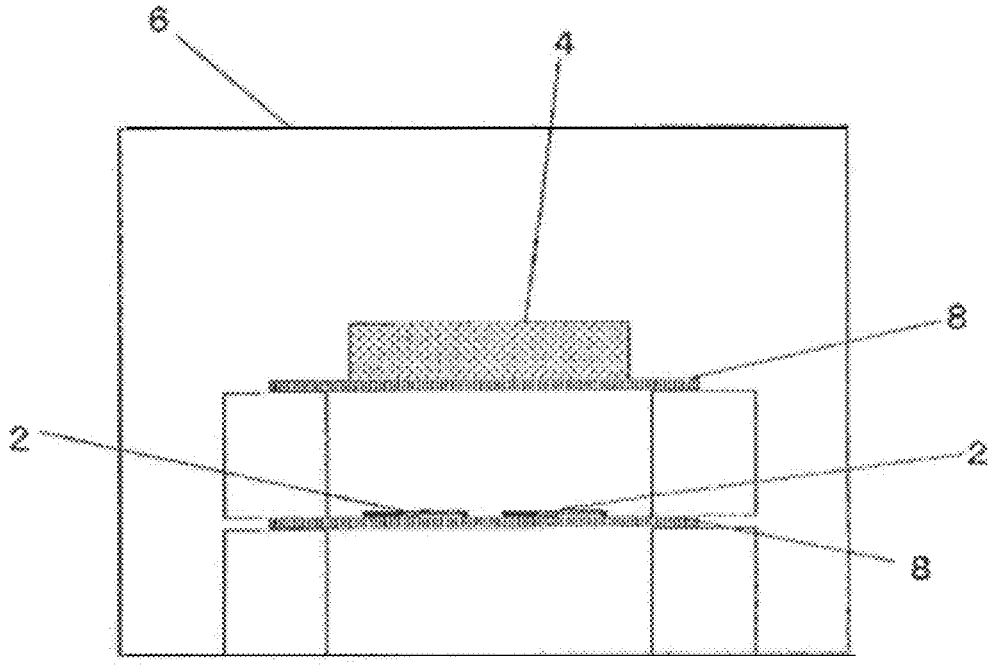
FIG. 1 is a schematic representation illustrating an example of a processing apparatus for use to perform an RH diffusion process according to the present invention.

According to the present invention, in order to make a sintered R-T-B-M magnet so that $R_2T_{14}B$ phases that include a lot of Dy in the surface region of the main phase are distributed over the entire magnet, a region including a heavy rare-earth element RH at a high concentration is formed continuously beforehand at an interface between the crystals of an $R_2T_{14}B$ compound that is the main phase of the sintered R-T-B-M magnet and the other phases.

Alloy to make Sintered R-T-B-M Magnet

A sintered R-T-B-M magnet material alloy according to the present invention has a continuous region in which a heavy rare-earth element RH has a high concentration and which covers a length of at least 10 μm along the major axis of crystals of an $R_2T_{14}B$ compound that is a main phase at an interface between the crystals of the $R_2T_{14}B$ compound and an R-rich phase. Those crystals of the $R_2T_{14}B$ compound that is the main phase are columnar ones.

The sintered R-T-B-M magnet material alloy of the present invention has a composition consisting essentially of 12 to 17 at % of R, 5 to 8 at % of B, 2 at % or less of additive element(s), and T and other inevitable impurities as the balance.

In this composition, R is at least one element selected from the group consisting of the rare-earth elements and yttrium. R includes both a light rare-earth element RL and a heavy rare-earth element RH. The light rare-earth element RL is one or both of Nd and Pr and the heavy rare-earth element RH is at least one of Tb, Dy, Ho.

B is boron, part of which may be replaced with carbon (C).

M is at least one element selected from the group consisting of Al, Ti, V, Cr, Mn, Ni, Cu, Zn, Ga, Zr, Nb, Mo, Ag, In, Sn, Hf, Ta, W, Pb and Bi.

T is a transition metal that includes Fe as a major component and that may include Co.

As described above, according to the present invention, there is a region including a heavy rare-earth element RH at a high concentration at the interface between the (columnar) crystals of an $R_2T_{14}B$ compound and an R-rich phase. And that region is a continuous one that covers a length of at least 10 μm along the major axis of the crystals of the $R_2T_{14}B$ compound. That is why if the sintered R-T-B-M magnet material alloy of the present invention is pulverized, the magnet material alloy will crack open along that interface between the crystals of the $R_2T_{14}B$ compound and the R-rich phase to form a lot of powder particles there. As a result, such a region including the heavy rare-earth element RH at a high concentration will cover the major part of the surface of those powder particles. In other words, sintered R-T-B-M magnet material alloy powder particles, of which the surface is mostly covered with such a region including the heavy rare-earth element RH at a high concentration, are obtained.

Such powder particles are compacted to obtain green compacts, which then go through a sintering process, thereby obtaining sintered magnets. In that case, the surface region of the $R_2T_{14}B$ compound crystal grains that are included in the sintered magnet thus obtained comes to have a relatively high RH concentration. Unless that region including the heavy rare-earth element RH at a high concentration covers a length of at least 10 μm continuously at the interface between the crystals of the $R_2T_{14}B$ compound that is a main phase and the R-rich phase in the sintered R-T-B-M magnet material alloy yet to be pulverized, the surface region of the main phase will not be sufficiently covered with a layer including Dy at a high concentration in the magnet to be eventually obtained by going through pulverization and sintering process steps.

In this description, a process step in which a sintered R-T-B-M magnet material alloy and a heavy rare-earth metal or alloy are loaded into a processing chamber and are subjected to a heat treatment at a temperature of 600° C. to 1,000° C. within an atmosphere at a pressure of $10^2$ Pa or less for at least 10 minutes and up to 48 hours will be referred to herein as an "RH diffusion process step". Also, in this description, the sintered R-T-B-M magnet material alloy yet to be subjected to the RH diffusion process step will be referred to herein as an "R-T-B-M master alloy" and the sintered R-T-B-M magnet material alloy that has gone through the RH diffusion process step will be referred to herein as an "sintered R-T-B-M magnet material alloy". In a preferred embodiment of the present invention, the R-T-B-M master alloy has a thickness of 1 mm or less, and therefore, the sintered R-T-B-M magnet material alloy also has a thickness of 1 mm or less. The sintered R-T-B-M magnet material alloy typically has a flake shape.

Hereinafter, preferred embodiments of a method for producing a sintered R-T-B-M magnet material alloy and a method for producing a sintered R-T-B-M magnet according to the present invention will be described.

Processing Space

First of all, the processing chamber to carry out the RH diffusion process in will be described. It will be described with reference to FIG. 1 how the diffusion process is carried out in a preferred embodiment of the present invention. FIG. 1 illustrates an exemplary arrangement of an R-T-B-M master alloy 2 and a bulk body 4 of a heavy rare-earth metal or alloy (which will be referred to herein as an "RH bulk body").

In the example illustrated in FIG. 1, flakes of the R-T-B-M master alloy 2 and the RH bulk body 4 are arranged so as to face each other with a predetermined gap left between them inside of a processing chamber 6 made of a refractory metal. In this description, the "flakes" refer to pieces of an ingot obtained by solidifying a molten alloy and preferably have a thin plate shape with a thickness of 1 mm or less. However, the length and width of those cast flakes are not particularly limited. The alloy to be obtained by the strip casting process to be described later ordinarily has a thickness of 1 mm or less. That is why even if the strip cast alloy is not particularly coarsely pulverized by some machine, the alloy will easily split into small pieces by itself.

A prime feature of the present invention is performing the RH diffusion process on the R-T-B-M master alloy yet to be pulverized, not on the sintered magnet body.

The processing chamber 6 shown in FIG. 1 includes a member for holding a plurality of R-T-B-M master alloys 2 and a member for holding the RH bulk body 4. Specifically, in the example shown in FIG. 1, the R-T-B-M master alloys 2 and the upper RH bulk body 4 are held on a net 8 made of Mo. However, the R-T-B-M master alloys 2 and the RH bulk body 4 do not have to be held in this way but may also be held using any other member.

The R-T-B-M master alloys 2 and the RH bulk body 4 may be arranged in any of the various patterns disclosed in Patent Document No. 3, for example.

In a preferred embodiment of the present invention, the heavy rare-earth element RH that has vaporized a little is introduced as described above to have a high concentration at the interface between the crystals of the $R_2T_{14}B$ compound, which is the main phase of the R-T-B-M master alloy 2, and the R-rich phase along the major axis of the crystals of the $R_2T_{14}B$ compound.

Figure 2:
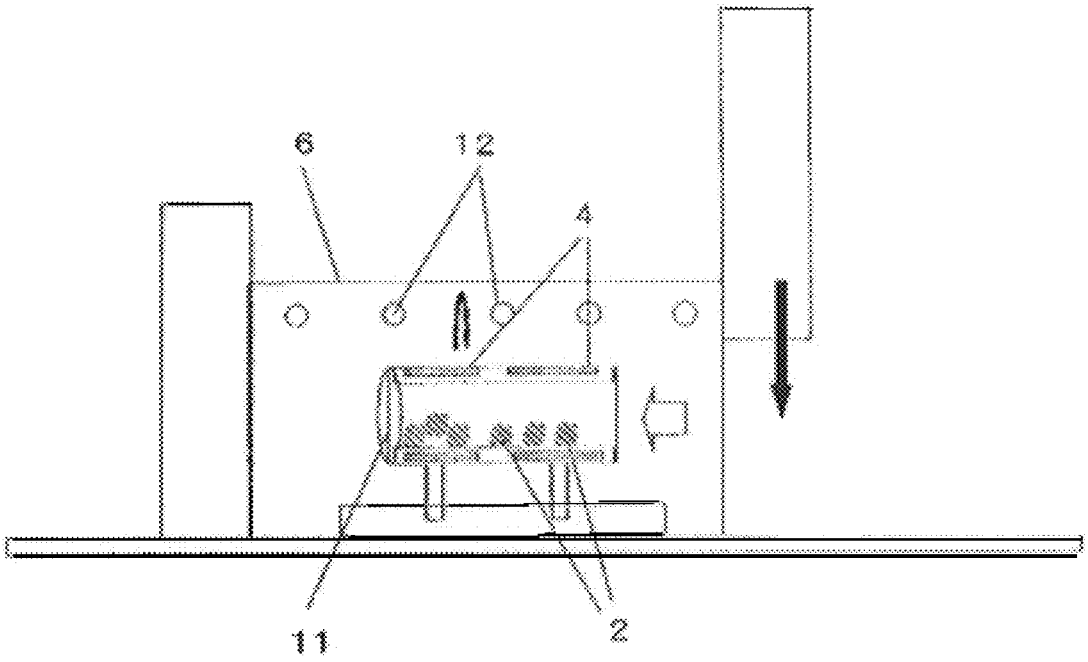
FIG. 2 is a schematic representation illustrating another example of a processing apparatus for use to perform the RH diffusion process of the present invention.

To perform such an RH diffusion process efficiently on a lot of R-T-B-M master alloys 2, a processing chamber such as the one illustrated in FIG. 2 may also be used. In the example illustrated in FIG. 2, the R-T-B-M master alloys 2 and the RH bulk body 4 are also arranged so as to face each other with a predetermined gap left between them inside of a processing chamber 6 made of a refractory metal. In this processing chamber, arranged is a rotating barrel 11 on which the RH bulk body 4 is fixed. And cast flakes of the R-T-B-M master alloys 2 are put into the rotating barrel 11. In this case, the RH diffusion process is preferably carried out with the rotating barrel 11 turned. Although a heating means (a heater 12) is provided inside of the processing chamber in the example illustrated in FIG. 2, the heating means may be arranged at any other position. For example, the heating means may be arranged on the rotating barrel 11. In any case, the heating process may be carried out by resistance heating, induction heating or any other known heating method.

Figure 3:
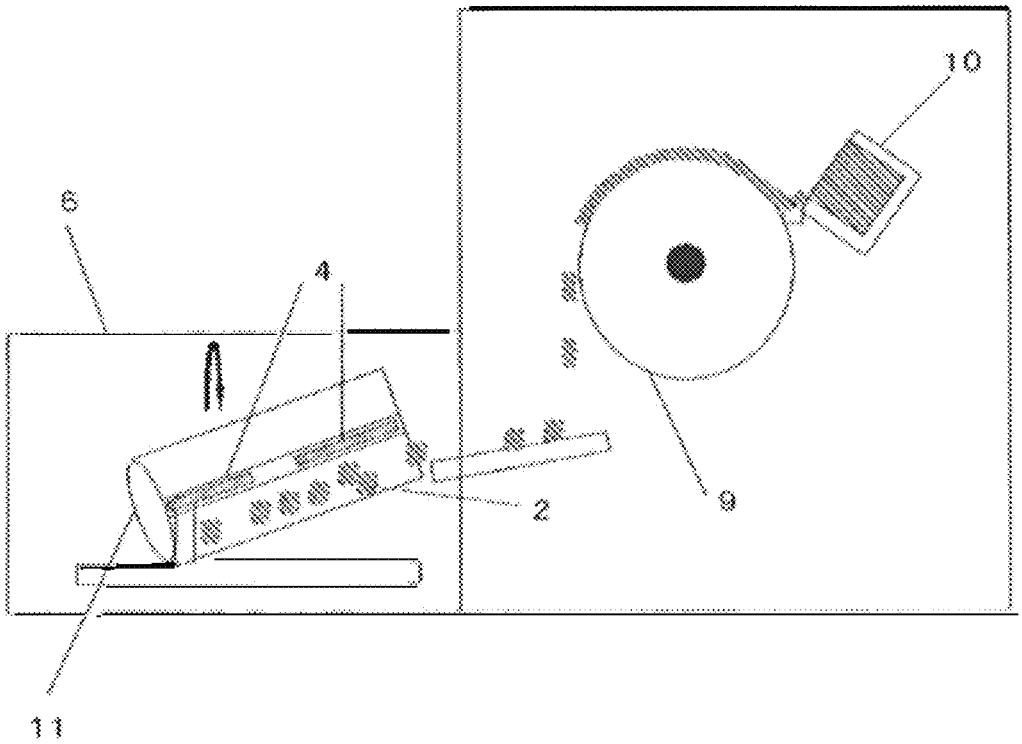
FIG. 3 is a schematic representation illustrating still another example of a processing apparatus for use to perform the RH diffusion process of the present invention.

FIG. 3 illustrates a modified example of the machine shown in FIG. 2. In the machine shown in FIG. 3, a strip caster for making an R-T-B master alloy is connected to the processing chamber shown in FIG. 2. The strip caster includes a crucible 10 to make a molten alloy and a chill roller 9 for quenching and solidifying the molten alloy. The chill roller 9 rotates at a predetermined velocity. The molten alloy that has been fed from the crucible 10 onto the surface of the rotating chill roller 9 moves and gets solidified on the chill roller 9 while having its heat dissipated by the chill roller 9. As a result, a solidified alloy is obtained. The solidified alloy is crushed into flakes, which are then loaded into the RH diffusion processing chamber.

Using the machine shown in FIG. 3, the R-T-B-M master alloy obtained can be immediately subjected to the RH diffusion process in the processing chamber.

During the heat treatment process, an inert atmosphere is preferably maintained inside the processing chamber. In this description, the "inert atmosphere" refers herein to a vacuum or an inert gas. Also, the "inert gas" may be a rare gas such as argon (Ar) gas but may also be any other gas as long as the gas is not chemically reactive between the RH bulk body and the R-T-B-M master alloy. The pressure of the inert gas is reduced so as to be lower than the atmospheric pressure. If the pressure of the atmosphere inside the processing chamber were close to the atmospheric pressure, then the heavy rare-earth element RH could not be supplied easily from the RH bulk body to the surface of the R-T-B-M master alloy. However, since the amount of the heavy rare-earth element RH diffused is determined by the rate of diffusion from the surface of the R-T-B-M master alloy toward the inner portion thereof, it should be enough to lower the pressure of the atmosphere inside the processing chamber to $10^2$ Pa or less, for example. That is to say, even if the pressure of the atmosphere inside the processing chamber were further lowered, the amount of the heavy rare-earth element RH diffused (and eventually the degree of increase in coercivity) would not change significantly. The amount of the heavy rare-earth element RH diffused is more sensitive to the temperature of the R-T-B-M master alloy, rather than the pressure.

The shape and size of the RH bulk bodies are not particularly limited. For example, the RH bulk bodies may have a plate shape or an indefinite shape. Optionally, the RH bulk bodies may be porous ones. The RH bulk bodies are preferably made of either a heavy rare-earth element RH or an alloy including 20 at % or more of at least one heavy rare-earth element RH. Examples of preferred alloys include an alloy of a heavy rare-earth element RH and Fe and an alloy of a heavy rare-earth element RH and Co.

Also, the higher the vapor pressure of the heavy rare-earth element RH included in the RH bulk bodies, the greater the amount of RH that can be introduced per unit time and the more efficient. Oxides, fluorides and nitrides including a heavy rare-earth element RH have so low vapor pressures that the heavy rare-earth element RH hardly diffuses under the conditions falling within these ranges of temperatures and degrees of vacuum. For that reason, even if the RH bulk bodies are made of an oxide, a fluoride or a nitride including the heavy rare-earth element RH, the coercivity cannot be increased effectively.

Composition of R-T-B-M Master Alloy

The alloy to prepare preferably has a composition that includes: 12 at % to 17 at % of R, which represents rare-earth elements (including Y) that include both a light rare-earth element RL and a heavy rare-earth element RH and which always includes either Nd or Pr as the light rare-earth element RL and at least one of Tb, Dy and Ho as the heavy rare-earth element RH; 5 at % to 8 at % of B, part of which is replaceable with C; 2 at % or less of an additive element M, which is at least one element selected from the group consisting of Al, Ti, V, Cr, Mn, Ni, Cu, Zn, Ga, Zr, Nb, Mo, Ag, In, Sn, Hf, Ta, W, Pb and Bi; and T (which is a transition metal that includes Fe as a major component and that possibly includes Co) and other inevitable impurities as the balance. In this case, part of R may be replaced with a heavy rare-earth element RH.

Examples of other inevitable impurities of the R-T-B-M master alloy include O, C, N, H, Si, Ca, Mg, S and P.

R-T-B-M Master Alloy Manufacturing Process

The R-T-B-M master alloy may be made by strip casting process, for instance. Hereinafter, it will be described how to make an R-T-B-M master alloy by strip casting process. The strip casting process adopted to make the R-T-B-M master alloy according to the present invention is disclosed in U.S. Pat. No. 5,383,978, for example.

First, the respective materials are weighed so as to have the composition described above and then melted by induction heating within an argon atmosphere to make a melt of the R-T-B-M master alloy. Next, this melt is kept heated at about 1,350° C. and then quenched by single roller process, thereby obtaining an R-T-B-M master alloy block with a thickness of about 0.3 mm. In this process step, the R-T-B-M master alloy block preferably has a thickness of 1 mm or less.

RH Diffusion Process Step

Next, the heavy rare-earth element RH is made to diffuse and penetrate efficiently into the R-T-B-M master alloy obtained in the previous process step. More specifically, an RH bulk body, including the heavy rare-earth element RH, and an R-T-B-M master alloy are loaded into the processing chamber shown in FIGS. 1 to 3 and then heated, thereby diffusing the heavy rare-earth element RH inward while supplying the heavy rare-earth element RH from the RH bulk body onto the surface of the R-T-B-M master alloy 2.

According to the present invention, by utilizing high affinity of the main phase surface region to the heavy rare-earth element RH, a continuous region including the heavy rare-earth element RH at a high concentration is formed at the interface between the crystals of the $R_2T_{14}B$ compound that is a main phase and the R-rich phase so as to cover a length of at least 10 μm along the major axis of the crystals of the $R_2T_{14}B$ compound.

By using a sintered R-T-B-M magnet material alloy with such a structure to make a sintered magnet, the resultant sintered R-T-B-M magnet can have high remanence and high coercivity in any part thereof.

The atmosphere in the processing chamber preferably has a pressure of $10^2$ Pa or less and the temperatures of the RH bulk body and the R-T-B-M master alloy are preferably maintained within the range of 600° C. to 1,000° C. for at least 10 minutes and up to 48 hours. This is a temperature range preferably adopted for the heavy rare-earth element RH to diffuse deeper inside by way of the grain boundary phase of the R-T-B-M master alloy 2. With such a temperature range adopted, the heavy rare-earth element RH will diffuse efficiently inside of the R-T-B-M master alloy 2.

Also, to perform this RH diffusion process step efficiently, the atmospheric gas preferably has a pressure falling within the range of $10^{-3}$ to $10^2$ Pa during the RH diffusion process step.

It should be noted that for that period of time of 10 minutes to 48 hours, the RH bulk body and the R-T-B-M master alloy certainly have their temperatures maintained within the range of 600° C. to 1,000° C. and the pressure is kept at $10^2$ Pa or less. However, neither the temperature nor the pressure is maintained at any particular value during that period.

Pulverization

As an example of a manufacturing process for producing the magnet of the present invention, a process in which pulverization is carried out in two stages (which will be referred to herein as "coarse pulverization" and "fine pulverization", respectively) will be described. However, according to the present invention, not just the manufacturing process to be described below but also any other manufacturing process may be adopted as well.

The sintered R-T-B-M magnet material alloy is preferably coarsely pulverized by hydrogen decrepitation process, which is a process for producing very small cracks in the alloy by taking advantage of its decrepitation and volume expansion due to hydrogen occlusion and thereby pulverizing the alloy. In the sintered R-T-B-M magnet material alloy of the present invention, the cracks are produced due to a difference in the rate of occluding hydrogen between the main phase and the R-rich phase (i.e., a difference in their volume variation). That is why according to the hydrogen decrepitation process, the main phase is more likely to crack on the grain boundary of the main phase. In the sintered R-T-B-M magnet material alloy of the present invention, a continuous region including a heavy rare-earth element RH at a high concentration is present at the interface between the crystals of the $R_2T_{14}B$ compound and the R-rich phase so as to cover a length of at least 10 μm along the major axis of the crystals of the $R_2T_{14}B$ compound. That is why if the sintered R-T-B-M magnet material alloy cracks along the grain boundary of the main phase, the majority of the surface of the powder particles will be covered with that region including the heavy rare-earth element RH at a high concentration.

In a hydrogen decrepitation process, normally the material alloy is exposed to pressurized hydrogen for a certain period of time. In some cases, the alloy may then be heated to a raised temperature to release excessive hydrogen. The coarse powder obtained by such a hydrogen decrepitation process has a huge number of internal cracks and a significantly increased specific surface. That is why the coarse powder is so active that a lot more oxygen would be absorbed when the powder is handled in the air. For that reason, the powder is preferably handled in an inert gas such as nitrogen, He or Ar gas. On top of that, as nitrification reaction could also occur at high temperatures, it is preferred that the coarse powder be handled in an He or Ar atmosphere if some increase in manufacturing cost could be afforded.

In the pulverization process, the content of inevitably contained oxygen, in particular, needs to be controlled. This is because oxygen will affect the magnetic properties and the manufacturing process of a magnet more seriously than any other one of various inevitable impurities. Once the sintered R-T-B-M magnet material alloy or its mixture has been pulverized, oxygen included in it is no longer removable in any subsequent process step. That is why the completed magnet will have at least as high an oxygen content as its powder in that case.

As the fine pulverization process, dry pulverization may be carried out using a jet pulverizer. In that case, nitrogen gas is usually used as a pulverization gas for this type of magnet. According to the present invention, however, a rare gas such as He or Ar gas is preferably used to minimize the content of nitrogen in the composition of the magnet. If a He gas is used, then considerably great pulverization energy can be produced. As a result, a fine powder, which can be used effectively in the present invention, can be obtained easily. However, as the He gas is expensive, such a gas is preferably circulated with a compressor introduced into the pulverizer. Hydrogen gas could also achieve a similar effect but is not preferred from an industrial point of view because the hydrogen gas is combustible.

Compaction

A compaction process to make the magnet of the present invention may be a known one. For example, the fine powder described above may be pressed and compacted with a die under a magnetic field. To minimize the amounts of oxygen, carbon and other impurities absorbed, the use of a lubricant is preferably minimized. But when a lubricant needs to be used, a highly volatile lubricant, which can be removed either during the sintering process or even before that, may be selectively used from known ones.

To minimize oxidation, it is preferred that the fine powder and a solvent be mixed together to make a slurry and then the slurry be compacted under a magnetic field. In that case, considering the volatility of the solvent, a hydrocarbon with a low molecular weight that can be vaporized almost completely in a vacuum at 250° C. or less may be selected for the next sintering process. Among other things, a saturated hydrocarbon such as isoparaffin is preferred. Also, the slurry may also be made by collecting the fine powder directly in the solvent.

The pressure to be applied during the compaction process is not particularly limited. However, the pressure should be at least 9.8 MPa and preferably 19.6 MPa or more, and the upper limit thereof is 245 MPa at most, and preferably 196 MPa. In any case, the compacting pressure is set so that the resultant compact has a green density of approximately 3.5 $Mg/cm^3$ to 4.5 $Mg/cm^3$. The magnetic field applied has a strength of 0.8 MA/m to 1.5 MA/m, for example.

Sintering

The sintering process is supposed to be carried out within either a vacuum or an inert gas atmosphere, of which the pressure is lower than the atmospheric pressure and where the inert gas refers to Ar and/or He gas(es).

Such an inert gas atmosphere, of which the pressure is lower than the atmospheric pressure, is preferably maintained by evacuating the sintering furnace with a vacuum pump and introducing the inert gas into the furnace. In that case, either evacuation or introduction of the inert gas may be performed intermittently. Or both the evacuation and the introduction of the inert gas may be carried out intermittently.

To remove sufficiently the lubricant and solvent that have been used in the fine pulverization process and the compaction process, preferably it is not until a binder removal process is done that the sintering process is started. The binder removal process may be carried out by keeping the compact heated to a temperature of 300° C. or less for 30 minutes to 8 hours within either a vacuum or an inert gas atmosphere, of which the pressure is lower than the atmospheric pressure. The binder removal process could be performed independently of the sintering process but the binder removal process and the sintering process are preferably performed continuously to increase the efficiency of the process and reduce the oxidation as much as possible. The binder removal process is preferably carried out within an inert gas atmosphere, of which the pressure is lower than the atmospheric pressure, in order to get the binder removal process done as efficiently as possible. Optionally, to get the binder removal process done even more efficiently, the heat treatment may be carried out within a hydrogen atmosphere.

In the sintering process, the compact is seen to release a gas while having its temperature raised. The gas released is mostly the hydrogen gas that has been introduced during the hydrogen decrepitation process. It is not until the hydrogen gas is released that the liquid phase is produced. That is why to release the hydrogen gas completely, the compact is preferably kept heated to a temperature of 700° C. to 850° C. for 30 minutes to 4 hours.

The sintering process preferably includes the steps of keeping the compact heated to a temperature of 650° C. to 1,000° C. for 10 to 240 minutes and then advancing the sintering at a higher temperature (of 1,000° C. to 1,200° C., for example).

Machining

The sintered R-T-B-M magnet of the present invention may be subjected to some ordinary kind of machining such as cutting or grinding to obtain a desired shape or size.

Surface Treatment

The sintered R-T-B-M magnet of the present invention is preferably subjected to some kind of surface coating treatment for anti-corrosion purposes. Examples of preferred surface coating treatments include Ni plating, Sn plating, Zn plating, vapor deposition of an Al film or an Al-based alloy film, and resin coating.

EXAMPLES

Example 1

First of all, R-T-B-M master alloys, which had been compounded to have the compositions of Samples #1 through #4 shown in the following Table 1, were obtained by strip casting process. The R-T-B-M master alloys had a flake shape and had a thickness of 0.2 to 0.4 mm.

TABLE 1

| | Composition (mass %) | | | | | | | | | | | |
|---|---|---|---|---|---|---|---|---|---|---|---|---|
| # | Pr | Nd | Dy | Fe | Co | Cu | Al | Ga | B | O | C | N |
| 1 | 3 | 27 | 0.5 | bal | 1.0 | 0.10 | 0.20 | 0.10 | 1.00 | 0.01 | 0.02 | 0.01 |
| 2 | 3 | 27 | 0.5 | bal | 1.0 | 0.10 | 0.00 | 0.00 | 1.00 | 0.01 | 0.02 | 0.01 |
| 3 | 3 | 27 | 0.5 | bal | 1.0 | 0.00 | 0.20 | 0.00 | 1.00 | 0.01 | 0.02 | 0.01 |
| 4 | 3 | 27 | 0.5 | bal | 1.0 | 0.00 | 0.00 | 0.10 | 1.00 | 0.01 | 0.02 | 0.01 |

R-T-B-M master alloys having any of these compositions shown in Table 1 were loaded into a process vessel with the configuration shown in FIG. 1. The process vessel for use in this specific example was made of Mo and included a member for holding a number of R-T-B-M master alloys and a member for holding an RH bulk body of Dy. A gap of about 5 mm to about 9 mm was left between the R-T-B-M master alloys and the RH bulk body. The RH bulk body was made of Dy with a purity of 99.9% and had dimensions of 5 mm (thickness)×30 mm (length)×30 mm (width).

Next, the process vessel shown in FIG. 1 was transferred to a vacuum heating furnace and subjected to an RH diffusion process. The process conditions were controlled so that the temperature was raised under a reduced pressure Ar atmosphere at a pressure of $1\times10^{-2}$ Pa and maintained at 900° C. for one to three hours and that 0.5 mass % of Dy would diffuse and be introduced into the R-T-B-M master alloys. In this manner, alloys to make sintered R-T-B-M magnets were obtained.

Next, a container was loaded with those cast flakes of the sintered R-T-B-M magnet material alloys and then introduced into a hydrogen pulverizer, which was filled with a hydrogen gas atmosphere at a pressure of 500 kPa. In this manner, hydrogen was absorbed into the cast alloy flakes at room temperature and then desorbed. By performing such a hydrogen process, the cast alloy flakes were decrepitated to obtain a coarse powder (i.e., a coarsely pulverized powder) with a size of 0.5 mm or less.

Thereafter, 0.05 wt % of zinc stearate was added as an aid for pulverization to the coarsely pulverized powder obtained by the hydrogen process and then the mixture was pulverized with a jet mill to obtain a powder with a particle size of approximately 3 μm when measured by the Fischer method.

The powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1,050° C. for four hours in a vacuum furnace, thus obtaining sintered magnets with a thickness of 50 mm, a length of 50 mm and a width of 50 mm.

Comparative Example 1

A master alloy was made by strip casting process so as to have the predetermined composition of Sample #5 shown in the following Table 2:

TABLE 2

| | Composition (mass %) | | | | | | | | | | | |
|---|---|---|---|---|---|---|---|---|---|---|---|---|
| # | Pr | Nd | Dy | Fe | Co | Cu | Al | Ga | B | O | C | N |
| 5 | 3 | 27 | 0.5 | bal | 1.0 | 0.10 | 0.20 | 0.10 | 1.00 | 0.01 | 0.02 | 0.01 |

After that, as in Samples #1 to #4 described above, its powder particles were also pressed and compacted while being aligned with a magnetic field applied. Thereafter, the powder compact was unloaded from the press machine and then subjected to a sintering process at 1,050° C. for four hours in a vacuum furnace, thus obtaining a sintered magnet with a thickness of 50 mm, a length of 50 mm and a width of 50 mm.

Comparative Example 2

Two alloys A and B to make a sintered R-T-B-M magnet were mixed together at a ratio of 9 to 1 so as to have the composition of Sample #6 in the following Table 3 when sintered. Next, the mixture was loaded into, and coarsely pulverized by, a hydrogen pulverizer, and then dry-pulverized using a jet pulverizer (jet mill) in nitrogen gas, thereby obtaining an R-T-B-M alloy mixed powder.

TABLE 3

| | | Composition (mass %) | | | | | | | | | | | |
|---|---|---|---|---|---|---|---|---|---|---|---|---|---|
| # | | Pr | Nd | Dy | Fe | Co | Cu | Al | Ga | B | O | C | N |
| 6 | Alloy A | 3 | 27 | 0.0 | bal | 1.0 | 0.10 | 0.20 | 0.10 | 1.00 | 0.01 | 0.02 | 0.01 |
| | Alloy B | 3 | 27 | 5.0 | bal | 1.0 | 0.10 | 0.20 | 0.10 | 1.00 | 0.01 | 0.02 | 0.01 |
| | sintered | 3 | 27 | 0.5 | bal | 1.0 | 0.00 | 0.20 | 0.10 | 1.00 | 0.01 | 0.02 | 0.01 |

After that, as in Samples #1 to #4 described above, the powder particles were also pressed and compacted while being aligned with a magnetic field applied. Thereafter, the powder compact was unloaded from the press machine and then subjected to a sintering process at 1,050° C. for four hours in a vacuum furnace, thus obtaining a sintered magnet with a thickness of 50 mm, a length of 50 mm and a width of 50 mm.

Then, each of those Samples #1 through #6 of sintered magnets was cut with a wire saw machine into 125 sintered magnets with a thickness of 7 mm, a length of 7 mm and a width of 7 mm. And the remanence $B_r$ and coercivity $H_{cJ}$ of each of those magnets, which had been magnetized with pulses of a magnetizing field with a strength of 3 MA/m, were measured at the end and center portions thereof using a B-H tracer. The magnetic properties thus measured are shown in the following Table 4:

TABLE 4

| | Magnetic properties (center) | | Magnetic properties (end) | |
|---|---|---|---|---|
| # | $B_r$ (T) | $H_{cJ}$ (kA/m) | $B_r$ (T) | $H_{cJ}$ (kA/m) |
| 1 | 1.45 | 1,050 | 1.45 | 1,050 |
| 2 | 1.45 | 960 | 1.45 | 960 |

TABLE 4-continued

| | Magnetic properties (center) | | Magnetic properties (end) | |
|---|---|---|---|---|
| # | $B_r$ (T) | $H_{cJ}$ (kA/m) | $B_r$ (T) | $H_{cJ}$ (kA/m) |
| 3 | 1.45 | 980 | 1.45 | 980 |
| 4 | 1.45 | 970 | 1.45 | 970 |
| 5 | 1.45 | 950 | 1.45 | 950 |
| 6 | 1.45 | 980 | 1.45 | 980 |

As can be seen from this Table 4, comparing the magnetic properties at the end portion to the ones at the center portion, neither the remanence $B_r$ nor the coercivity $H_{cJ}$ was different between the two portions in any of Samples #1, #5 and #6. Specifically, Sample #1 had a remanence $B_r$ of 1.45 T and a coercivity $H_{cJ}$ of 1,050 kA/m in both of the center and end portions thereof. Sample #5 had a remanence $B_r$ of 1.45 T and a coercivity $H_{cJ}$ of 950 kA/m in both of the center and end portions thereof. And Sample #6 had a remanence $B_r$ of 1.45 T and a coercivity $H_{cJ}$ of 980 kA/m in both of the center and end portions thereof.

As can be seen from Table 4, even though Sample #1 representing an example of the present invention included more Dy than any of Samples #5 and #6 representing comparative examples, the coercivity $H_{cJ}$ increased significantly in both of the center and end portions of the magnet without causing any decrease in remanence $B_r$.

Example 2

An R-T-B-M master alloy of Sample #7 that had been compounded so as to have the same composition as Sample #1 shown in Table 1 was made by strip casting process.

After that, the master alloy was subjected to an RH diffusion process on the same manufacturing process conditions as in Sample #1 of Example 1. And sintered magnets were made so as to have three different sizes and the same permeance coefficient of 1. Specifically, one sintered magnet had a thickness of 5 mm, a length of 8 mm and a width of 8 mm. Another magnet had a thickness of 10 mm, a length of 16 mm and a width of 16 mm. And the other magnet had a thickness of 30 mm, a length of 48 mm and a width of 48 mm.

Comparative Example 3

A sintered R-T-B-M magnet body having the composition of Sample #8 shown in the following Table 5 was made by performing the following manufacturing process:

TABLE 5

| | Composition (mass %) | | | | | | | | | | | |
|---|---|---|---|---|---|---|---|---|---|---|---|---|
| # | Pr | Nd | Dy | Fe | Co | Cu | Al | Ga | B | O | C | N |
| 8 | 3 | 27 | 0.5 | bal | 1.0 | 0.10 | 0.20 | 0.10 | 1.00 | 0.01 | 0.02 | 0.01 |

An R-T-B-M master alloy, which had been prepared so as to have the composition of Sample #8 shown in this Table 5, was made by strip casting process and then loaded into a hydrogen pulverizer, which was filled with a hydrogen gas atmosphere at a pressure of 500 kPa. In this manner, hydrogen was absorbed into the cast alloy flakes at room temperature and then desorbed. By performing such a hydrogen process, the cast alloy flakes were decrepitated to obtain a powder in indefinite shapes with sizes of about 0.15 mm to about 0.2 mm.

Thereafter, 0.05 wt % of zinc stearate was added as an aid for pulverization to the coarsely pulverized powder obtained by the hydrogen process and then the mixture was pulverized with a jet mill to obtain a powder with a particle size of approximately 3 μm.

The powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1,050° C. for four hours in a vacuum furnace, thus obtaining sintered magnet bodies that had three different sizes and the same permeance coefficient of 1. Specifically, one sintered magnet body had a thickness of 5 mm, a length of 8 mm and a width of 8 mm. Another magnet body had a thickness of 10 mm, a length of 16 mm and a width of 16 mm. And the other magnet body had a thickness of 30 mm, a length of 48 mm and a width of 48 mm.

These sintered R-T-B-M magnet bodies with three different sizes were acid-cleaned with a 0.3% nitric acid aqueous solution, dried, and then arranged in a process vessel with the configuration disclosed in Patent Document No. 3. The process vessel was made of Mo and included a member for holding a plurality of sintered R-T-B-M magnet bodies and a member for holding two RH bulk bodies. A gap of about 5 mm to about 9 mm was left between the sintered R-T-B-M magnet bodies and the RH bulk bodies. The RH bulk bodies were made of Dy with a purity of 99.9% and had a thickness of 5 mm, a length of 30 mm and a width of 30 mm.

Next, the process vessel loaded with those sintered R-T-B-M magnet bodies with the three different sizes was heated in a vacuum heat treatment furnace to conduct a Dy diffusion process as disclosed in Patent Document No. 3, which was carried out by raising the temperature under a pressure of $1\times10^{-2}$ Pa and maintaining the temperature at 900° C. so that the concentration of Dy introduced by diffusion into each of those samples became 0.5 mass %. After that, an aging treatment was carried out at 500° C. for 120 minutes under a pressure of 2 Pa, thereby obtaining sintered R-T-B-M magnets.

As for Sample #7 representing an example of the present invention and Sample #8 representing a comparative example, the percentages of thermal flux loss were calculated for the three different sizes (consisting of thickness, length and width in this order) of 5 mm×8 mm×8 mm, 10 mm×16 mm×16 mm, and 30 mm×48 mm×48 mm. In this case, the thermal flux loss indicates how much the total flux of a sintered magnet that had been magnetized with pulses of a magnetizing field with a strength of 3 MA/m and then was heated to 60° C. decreased compared to that of a sintered magnet that had also been magnetized with a field of the same strength and then was just maintained at an ordinary temperature of 23° C. The results of the measurements are shown in the following Table 6:

TABLE 6

| | Thermal flux loss (%) | | |
|---|---|---|---|
| # | When thickness was 5 mm | When thickness was 10 mm | When thickness was 30 mm |
| 7 | 0 | 0 | 0 |
| 8 | 0 | 2 | 5 |

As can be seen from the results shown in Table 6, no thermal flux loss was observed at all in Sample #7 even if its sizes (thickness/length/width) changed from 5 mm×8 mm×8 mm into 10 mm×16 mm×16 mm and then into and 30 mm×48 mm×48 mm. As for Sample #8 on the other hand, the thermal flux loss increased as its sizes (thickness/length/width) changed from 5 mm×8 mm×8 mm into 10 mm×16 mm×16 mm and then into and 30 mm×48 mm×48 mm.

Figure 4:
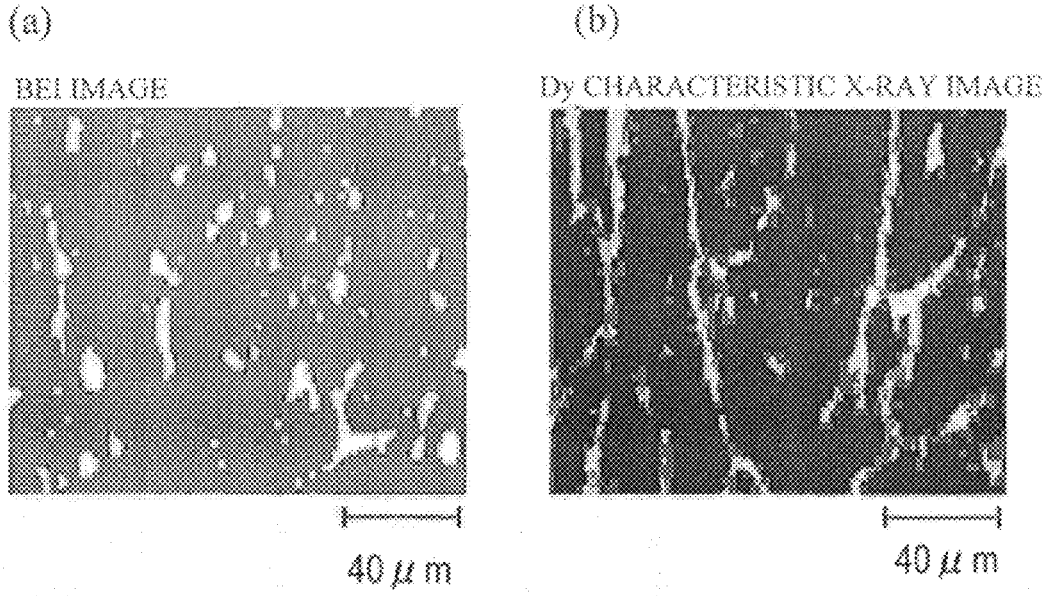
FIGS. 4(*a*) and 4(*b*) are respectively a backscattered electron image and a Dy characteristic X-ray image of a sintered R-T-B-M magnet material alloy representing a specific example of the present invention.

The present inventors analyzed the structure of the sintered R-T-B-M magnet material alloy of Sample #7. As a result, the backscattered electron image (see FIG. 4(*a*)) and Dy characteristic X-ray image (see FIG. 4(*b*)) we obtained both proved that Dy was included at a high concentration on the surface region of the main phase. The present inventors also measured the concentration of the heavy rare-earth element RH that was included continuously in the main phase of cast alloy flakes of the sintered R-T-B-M magnet material alloy. As a result, we discovered that the region including Dy at a high concentration in the sintered R-T-B-M magnet material alloy always had a length of at least 10 μm.

In Sample #7, the coercivity was much less variable between the center and end portions of the magnet than in Sample #8. Also, even if the thickness of the sintered magnet body was changed from 5 mm into 10 mm and then into 30 mm, no thermal flux loss was observed at all in Sample #7. These results were obtained probably because Dy should have diffused and reached deep inside the sintered magnet of Sample #7, whereas that should not been the case with Sample #8. This is because the sintered magnet of the present invention was made of a sintered R-T-B-M magnet material alloy powder in which a region including Dy as a heavy rare-earth element RH at a high concentration had been formed by the RH diffusion process so as to cover a length of at least 10 μm at the interface between the crystals of an $R_2T_{14}B$ compound as a main phase and the R-rich phase along the major axis of the $R_2T_{14}B$ compound.

INDUSTRIAL APPLICABILITY

According to the present invention, a sintered R-T-B-M magnet can be produced so as to have high remanence and high coercivity everywhere. Thus, the magnet of the present invention can be used effectively in a motor for a hybrid car and in numerous types of consumer electronic appliances that are often exposed to high temperatures.

REFERENCE SIGNS LIST

| | |
|---|---|
| 2 | R-T-B-M master alloy |
| 4 | RH bulk body |
| 6 | processing chamber |
| 8 | net of Mo |
| 9 | chill roller |
| 10 | crucible |
| 11 | rotating vessel |
| 12 | heating means |

The invention claimed is:

1. A material alloy used to produce a sintered R-T-B-M magnet having a composition that comprises:

12 at % to 17 at % of R, which represents rare-earth elements that include both a light rare-earth element RL and a heavy rare-earth element RH and which includes either Nd or Pr as the light rare-earth element RL and at least one of Tb, Dy and Ho as the heavy rare-earth element RH;

5 at % to 8 at % of B, part of which is replaceable with C;

2 at % or less of an additive element M, which is at least one element selected from the group consisting of Al, Ti, V, Cr, Mn, Ni, Cu, Zn, Ga, Zr, Nb, Mo, Ag, In, Sn, Hf, Ta, W, Pb and Bi; and T (which is a transition metal that includes Fe as a major component and that possibly includes Co) and inevitable impurities as the balance, wherein a continuous region where the heavy rare-earth element RH has a high concentration is present at an interface between crystals of an $R_2T_{14}B$ compound that is a main phase and an R-rich phase so as to cover a length of at least 10 μm along the major axis of the crystals of the $R_2T_{14}B$ compound.

2. A method for producing a material alloy used to produce a sintered R-T-B-M magnet, the method comprising the steps of:

providing an R-T-B-M master alloy that includes: 12 at % to 17 at % of R, which represents rare-earth elements that include both a light rare-earth element RL and a heavy rare-earth element RH and which always includes either Nd or Pr as the light rare-earth element RL and at least one of Tb, Dy and Ho as the heavy rare-earth element RH; 5 at % to 8 at % of B, part of which is replaceable with C; 2 at % or less of an additive element M, which is at least one element selected from the group consisting of Al, Ti, V, Cr, Mn, Ni, Cu, Zn, Ga, Zr, Nb, Mo, Ag, In, Sn, Hf, Ta, W, Pb and Bi; and T (which is a transition metal that includes Fe as a major component and that possibly includes Co) and inevitable impurities as the balance;

providing a metal or alloy of the heavy rare-earth element RH that includes 20 at % or more of the heavy rare-earth element RH; and putting the R-T-B-M master alloy and the metal or alloy of the heavy rare-earth element RH in a processing space with a gap between the R-T-B-M master alloy and the metal or alloy of the heavy rare-earth element RH and subjecting the master alloy and the metal or alloy of the heavy rare-earth element RH to a heat treatment at a temperature of 600° C. to 1,000° C. within an atmosphere at a pressure of 10 Pa or less for at least 10 minutes and up to 48 hours.

3. The method of claim 2, wherein the R-T-B-M master alloy is prepared by strip casting process.

4. A method for producing a sintered R-T-B-M magnet, the method comprising the steps of:

providing the material alloy of claim 1;

pulverizing the material alloy to obtain a material alloy powder;

compacting the material alloy powder to obtain a powder compact; and sintering the powder compact.

5. A sintered R-T-B-M magnet produced by the method of claim 4.

* * * * *